US006203287B1

(12) United States Patent
Hendrix et al.

(10) Patent No.: US 6,203,287 B1
(45) Date of Patent: Mar. 20, 2001

(54) FLUID COMPRESSOR WITH AIRFLOW MANIFOLD THAT INCLUDES MEANS FOR DISCHARGING PARTICULATED MATTER FROM THE COMPRESSOR AND METHOD

(75) Inventors: Dean P. Hendrix; Charles A. Swartz, both of Mocksville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/387,118

(22) Filed: Aug. 31, 1999

(51) Int. Cl.[7] ..... F04F 1/18; F04B 17/00; F28G 17/00; F28F 13/12

(52) U.S. Cl. ..... 417/313; 417/364; 165/95; 165/119

(58) Field of Search ..... 417/234, 364, 417/366, 313; 165/95, 119; 123/41.49; 60/39.092

(56) References Cited

U.S. PATENT DOCUMENTS

| | | | | |
|---|---|---|---|---|
| 2,728,411 | * | 12/1955 | Pasturczak | 183/67 |
| 3,856,439 | * | 12/1974 | Moehrbach | 417/312 |
| 3,995,603 | | 12/1976 | Thien et al. | 123/41.51 |
| 4,022,550 | * | 5/1977 | Brink et al. | 417/234 |
| 4,071,009 | | 1/1978 | Kraina | 123/198 |
| 4,180,024 | | 12/1979 | Hernandez | 123/41.46 |
| 4,226,217 | | 10/1980 | Haslbeck et al. | 123/41.62 |
| 4,455,971 | | 6/1984 | Kirchweger et al. | 123/41.7 |
| 4,590,889 | | 5/1986 | Hiereth | 123/41.05 |
| 4,600,153 | * | 7/1986 | Stone | 293/543 |
| 4,706,615 | * | 11/1987 | Scadding | 123/41.01 |
| 4,747,275 | | 5/1988 | Amr et al. | 62/419 |
| 4,766,952 | * | 8/1988 | Onodera | 165/95 |
| 4,884,416 | * | 12/1989 | Hwang | 62/303 |
| 4,934,449 | * | 6/1990 | Watt et al. | 165/41 |
| 5,244,347 | | 9/1993 | Gallivan et al. | 416/189 |
| 5,342,173 | | 8/1994 | Vera | 416/169 A |
| 5,386,873 | * | 2/1995 | Harden, III et al. | 165/47 |
| 5,526,872 | * | 6/1996 | Gielda et al. | 165/41 |
| 5,676,197 | * | 10/1997 | Diebold et al. | 165/41 |
| 5,735,337 | * | 4/1998 | Edwards | 165/41 |

* cited by examiner

*Primary Examiner*—Timothy S. Thorpe
*Assistant Examiner*—Timothy P. Solak
(74) *Attorney, Agent, or Firm*—Michael Best & Friedrich LLP

(57) ABSTRACT

A compressor including an airflow manifold located within a compressor housing where the airflow manifold includes a heat exchanger flow connected to a shroud that includes a hopper that terminates in a spout that extends through the bottom compressor housing panel and is located outside the compressor housing to permit particulate matter dislodged from the heat exchanger to be discharged from the compressor housing.

11 Claims, 4 Drawing Sheets

COMPRESSION MODULE
PRIME MOVER

FLUID COMPRESSOR WITH AIRFLOW MANIFOLD THAT INCLUDES MEANS FOR DISCHARGING PARTICULATED MATTER FROM THE COMPRESSOR AND METHOD

BACKGROUND OF THE INVENTION

The invention relates to a fluid compressor and more specifically the invention relates to a fluid compressor having an airflow manifold enclosed by a compressor housing where the airflow manifold includes a heat exchanger and a shroud with integral hopper means for discharging particulate matter dislodged from the heat exchanger out of the compressor housing.

Fan shrouds used on engine driven equipment, such as compressors, typically utilize pusher type fans to draw ambient air into the compressor housing. The drawn air is supplied to the compression module and also is used to cool the engine and other compressor components. The drawn air is flowed through a heat exchanger to reduce the temperature of a compressor system fluid such as engine coolant for example. The drawn air enters the heat exchanger through a heat exchanger inlet side and exits the heat exchanger through a heat exchanger discharge side. Over time, dirt and other particulate matter entrained in the drawn air collects and accumulates in the heat exchanger. The collected particulate matter diminishes the efficiency and cooling capacity of the heat exchanger and as a result it is necessary to regularly flush the accumulated particulate matter out from the heat exchanger.

The particulate matter is dislodged from the heat exchanger by reversing the flow of fluid through the heat exchanger: supplying a pressurized fluid such as air to the heat exchanger discharge side and flowing the pressurized air and particulate matter entrained in the air out the heat exchanger inlet side. The pusher fan is typically enclosed by a fan shroud that encloses the fan and inlet side. The entrained particulate matter dislodged from the heat exchanger is trapped in the shroud interior.

The particulate matter trapped in the shroud must immediately be removed from the shroud to prevent the particulate matter from reentering and again accumulating in the heat exchanger when compressor operation is resumed. Removal of the collected particulate matter from the shroud is usually accomplished by removing the shroud or by providing access to the inside of the shroud with doors or covers. If covers and doors are used they must be opened or removed to permit the removal of the particulate matter by hand or by pressure washing. Shroud removal and door/cover removal are awkward, time consuming, and difficult cleaning methods to perform due to the traditional inaccessibility of the heat exchanger in the compressor housing. In the event doors or covers are not provided on the shroud, a technician must usually remove the collected particulate matter by inserting his hand into the shroud interior. This manual method of cleaning out the shroud frequently results in the technician injuring his hand on the sharp heat exchanger fins or fan blade, and also frequently results in the technician damaging the heat exchanger fins as a result of hand or tool contact with the fins.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid compressor comprising: a fluid compression module; a prime mover for driving the fluid compression module; a compressor housing defining a housing interior, the compressor housing having a first housing panel, the fluid compression module and prime mover being located in the housing interior; and an airflow manifold located in the housing interior, downstream from the prime mover and compression module, the manifold comprising a heat exchanger flow connected to a shroud that includes a hopper, the hopper terminating in a spout that extends through first panel of the compressor housing.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Figure 1:
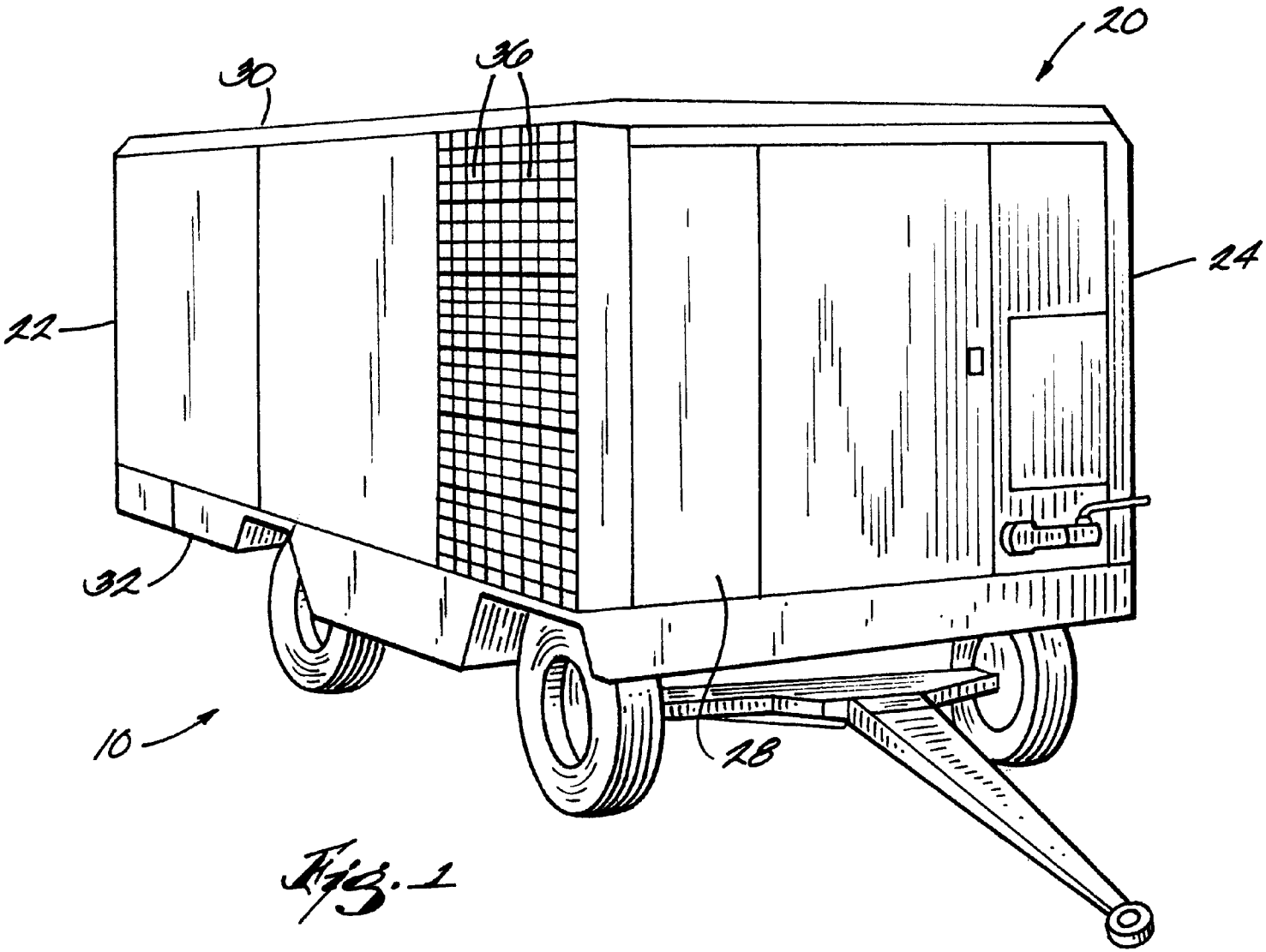
FIG. 1 is a perspective view of a fluid compressor that includes the airflow manifold of the present invention.
Figure 2:
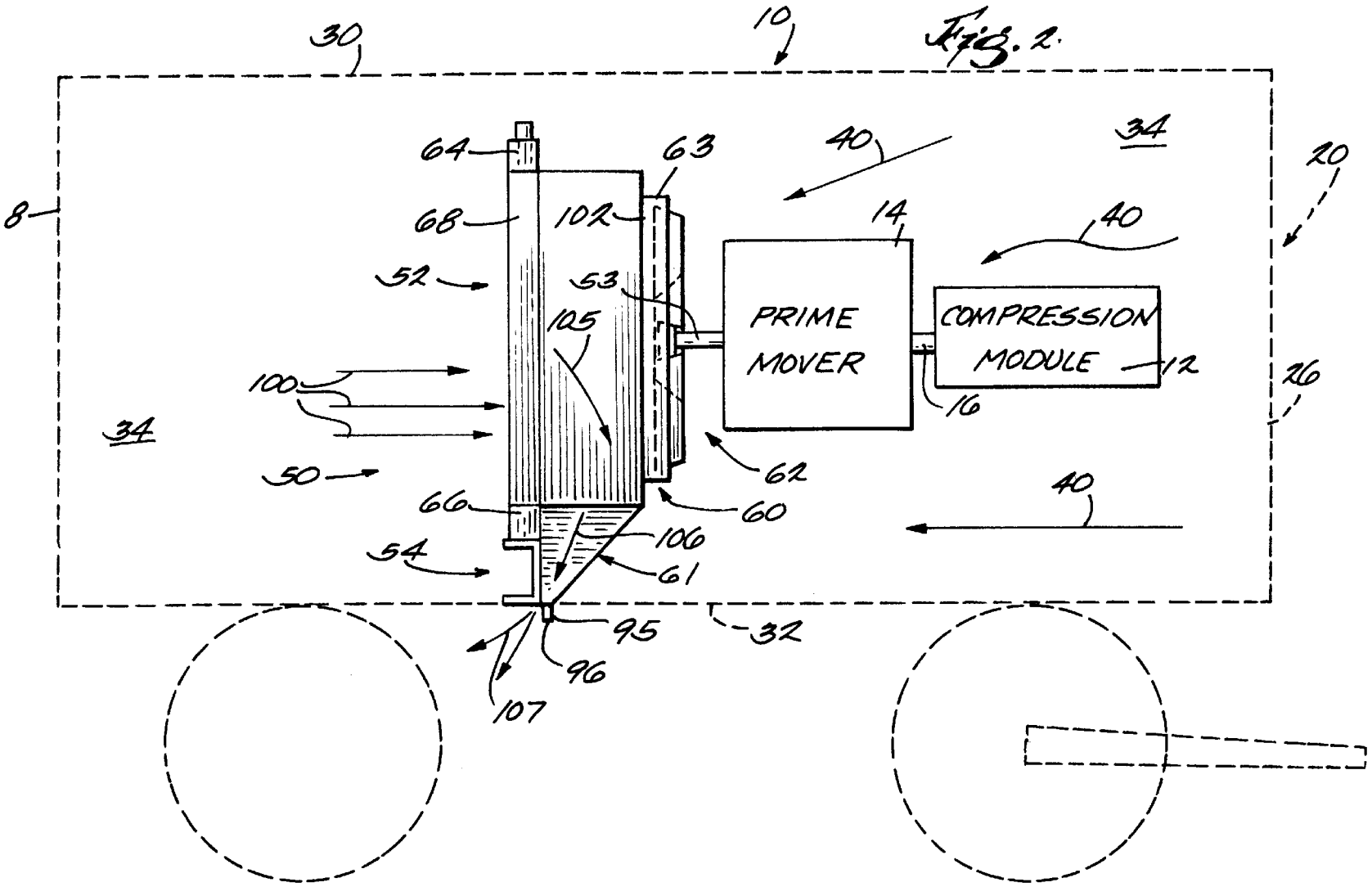
FIG. 2 is a schematic representation of the compressor of FIG. 1 illustrating the location of the airflow manifold within the compressor housing.

Turning now to the drawings wherein like parts are referred to by the same number throughout the several views, and particularly FIGS. 1 and 2 which generally illustrate fluid compressor 10 that includes the airflow manifold of the present invention; the compressor 10 generally includes a compression module 12 that is driven by prime mover 14 through coupling 16. The compression module may be any compression module adapted to compress a fluid such as air, and the prime mover may be any prime mover suitable to effectively drive the compression module. However, for purposes of describing the preferred embodiment of the invention, the compression module is a rotary screw airend having interengaging male and female rotors and the prime mover is a diesel engine.

Compressor 10 includes a housing 20 that is comprised of housing side panels 22 and 24, end panels 26 and 28, and top and bottom panels 30 and 32 respectively. The housing side panels 22 and 24, housing end panels 26 and 28, housing top panel 30 and housing bottom panel 32 together define housing interior 34. The prime mover and compression module and airflow manifold 50 are located within the housing interior. Housing inlets 36 are provided on one or more of the housing panels and as shown in FIG. 1, the inlet openings are provided along the side panels 22 and 24.

During operation of compressor 10, ambient air is drawn through the housing inlets 36 and into the compressor interior 34 in the direction generally identified by arrows 40. The air passes around the compression module and a portion of the drawn air enters the compression module through the compression module inlet valve (not shown). The air that does not enter the compression module continues downstream around the prime mover 14 and substantially all of the drawn air continues through airflow manifold assembly 50.

The airflow manifold assembly 50 is comprised of cooler or heat exchanger 52 that is attached to a rigid support channel 54, and the heat exchanger and channel together close open side 57 of defined by shroud 60 and hopper 61 while the shroud side 58 opposite open side 57 includes an inlet opening 59 that supports rotation of fan 62. For purposes of describing the preferred embodiment of the invention, the fan is directly driven by prime mover 14 through coupling 53 however it should be understood the fan may be driven by any suitable driving means such as a hydraulic motor for example.

The airflow manifold 50 of the present invention permits safe, simple, and effective removal of particulate matter from the shroud and hopper.

Cooler 52 includes upper manifold 64 and lower manifold 66 and heat exchanger core 68 which flow connects the manifolds 64 and 66.

Coolant from prime mover 14 enters the upper manifold 64 continues through conduits in the heater core, through lower manifold 66 and returns to the prime mover. The conduits in the heat exchanger core are not illustrated in the drawing figures. Cooler 52 is of conventional design well known to one skilled in the relevant art and further description of the cooler is not required. Additionally, although one heat exchanger is illustrated and disclosed a plurality of heat exchangers could be used in combination and also the one or more heat exchanger could be used for any required purpose such as to cool oil injected into the compression module for example.

The elongate rigid support channel 54 has a C-shaped cross section comprised of upper and lower horizontal channel webs 55*a,* 55*b* respectively that are joined by vertical web 55*c*. The channel is attached to the lower manifold 64 at the upper horizontal channel portion 55*a* by a weld or other suitable conventional connection means. As shown in FIG. 2, the lower channel web 55*b* is seated on bottom housing panel 32. The lower web 55*b* may in turn be welded, bolted or otherwise fixed to the compressor housing panel 32. The support channel 54 and heat exchanger 52 together comprise a substantially planar structure that serves to close open side 57 defined by shroud 60 and hopper 61. See FIG. 2.

In an alternate embodiment of the invention, the heat exchanger alone would substantially close open side 57.

Figure 3:
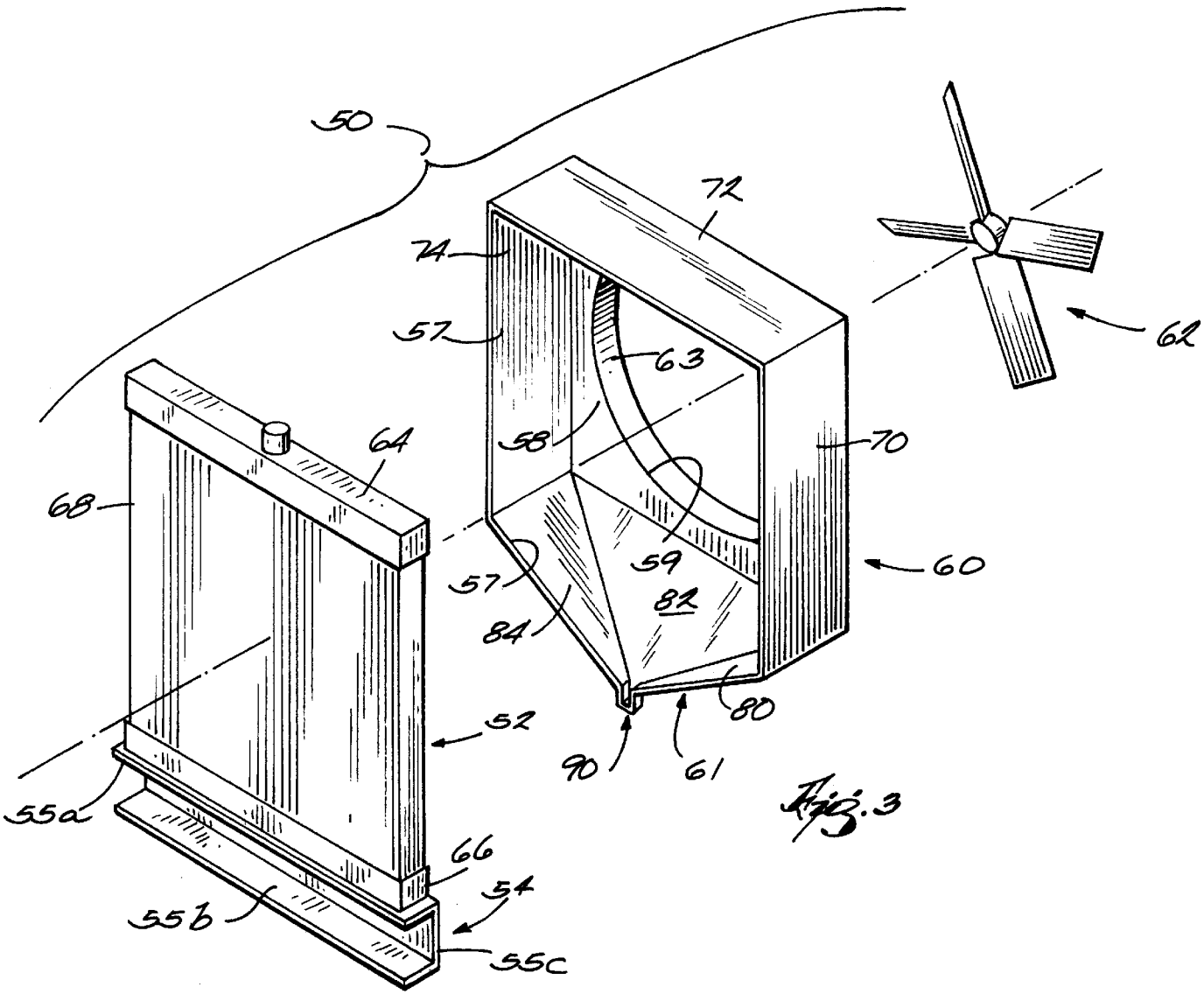
FIG. 3 is an exploded perspective view of components of the airflow manifold of FIG. 2.
Figure 4:
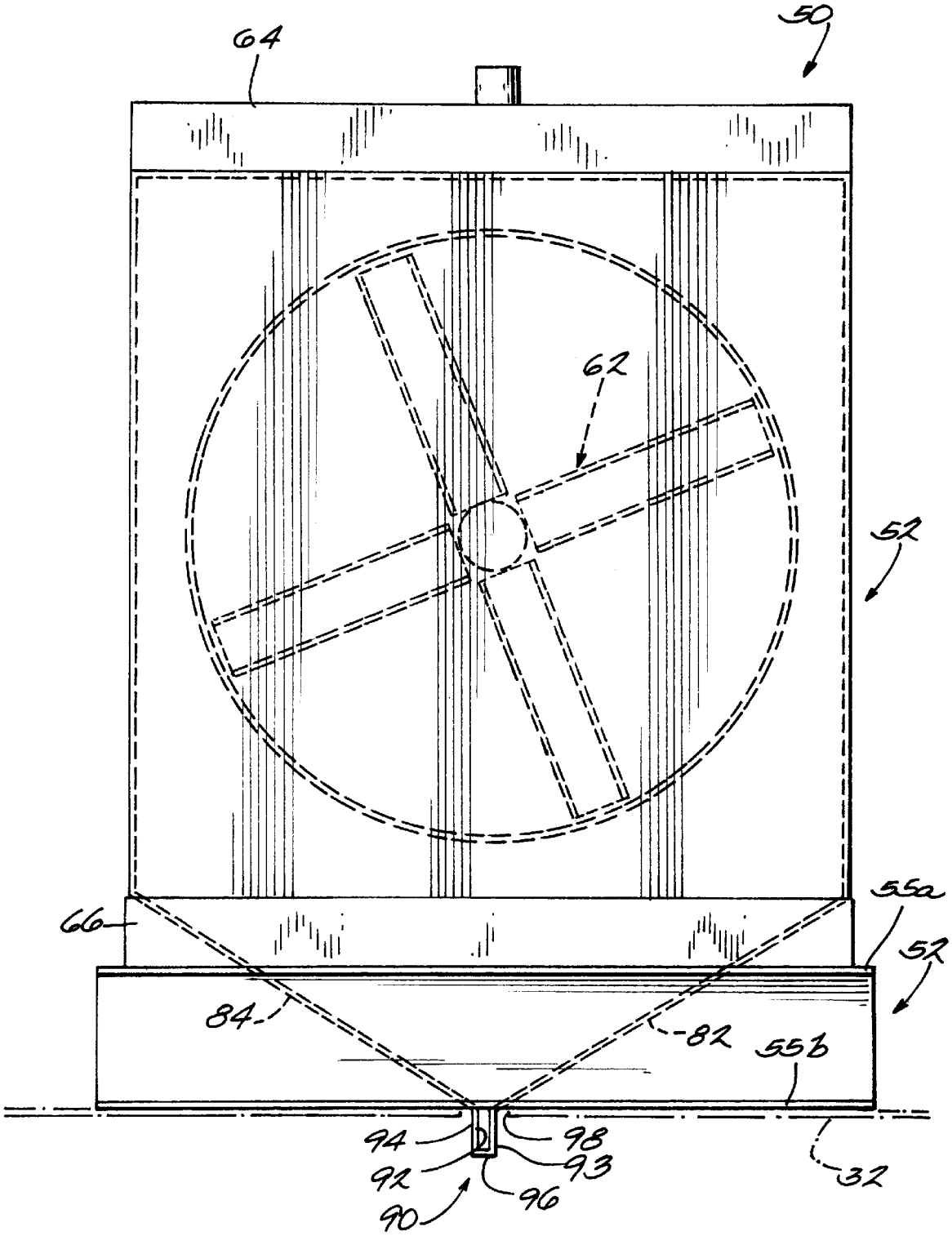
FIG. 4 is a left elevational view of the airflow manifold of FIG. 2.

The shroud is attached to the channel 54 and heat exchanger 52 in a conventional manner using weld or fasteners to make the required connection. Shroud 60 includes walls 70, 72, and 74 which are joined by wall 58. Shroud wall 58 includes outwardly extending ring 63 that defines airflow inlet 59. As shown in FIG. 3, the shroud includes a hopper 61 with sides 80, 82, and 84 that extend downwardly and inwardly from respective shroud sides 70, 58, and 74 and terminate in rectangular spout 90. The spout 90 as illustrated in the Figures is defined by sides 93, 94, 95, and bottom 96. The spout is closed except for discharge side 92 that is coplanar with open side 57. As shown in FIG. 4, when the airflow manifold is located in interior 34, spout 90 is passed through opening 98 in compressor housing bottom panel 32. The closed bottom 96 impedes and as a result slows the movement of particulate matter out of the shroud. It is believed that because the particulate matter is slowed as it moves out of the spout, the particulate matter is more likely to land in a receptacle under the spout then if the particulate matter was discharged unabated.

In addition to the rectangular spout 90, the spout may also be cylindrical with a closed sidewall and an open discharge end, semi-cylindrical with an opening along the sidewall and at the spout end, or any other suitable configuration. The spout 90 may be closed by a removable cap that covers the open spout between cooler cleanings.

Fan 62 is a conventional pusher fan that is directly driven by prime mover coupling 53. However, it should be understood that the fan could be any suitable fan driven by any other suitable means such as by an electric motor for example. As shown in FIG. 4, the fan is located in the ring 63 and draws ambient air into the compressor interior 34 and through manifold shroud inlet 59.

When it is necessary to clean the heat exchanger core 68, pressurized fluid such as air is applied to the core in the direction represented by arrows 100. The pressurized fluid dislodges particulate matter accumulated in the core and forces it out of the core and into the hopper chamber 102 in the direction of arrow 105. See FIG. 2. The particulate matter continues down into the hopper 61 in the direction 106 and is discharged out of the hopper through spout discharge side 92 in the direction 107. A receptacle such as a bucket can be placed beneath the spout to catch the discharged particulate matter.

In summary, our invention provides the following benefits and improvements over the prior art: allows the removal and collection of particulate matter accumulated in a compressor heat exchanger without requiring access to the inside of the shroud or hopper; prevents damage to the cooler fins from tools being used to remove debris from inside the shroud; reduces the risk of injury to technician by eliminating the need to physically access the area inside the shroud and hopper to remove debris and particulate matter from the shroud and hopper; and provides easier and faster cleaning of the cooler core.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A fluid compressor comprising:

A) a fluid compression module;

B) a prime mover for driving the fluid compression module;

C) a compressor housing defining a housing interior, the compressor housing having a first housing panel, the fluid compression module and prime mover being located in the housing interior; and D) an airflow manifold located in the housing interior, downstream from the prime mover and compression module, the manifold comprising a heat exchanger flow connected to a shroud that includes a hopper, the hopper including a spout with a discharge side that extends through the bottom panel of the compressor housing, wherein the shroud comprises an open side, a closed side having a fan ring which defines an air inlet; the airflow manifold further comprising a fan means locate in said ring; and a channel member which supports said heat exchanger, the heat exchanger and channel adapted to close the open shroud side when the shroud is flow connected to the heat exchanger; wherein the shroud's open side and spout's discharge side are coplanar.

2. The fluid compressor as claimed in claim 1 wherein the airflow manifold hopper includes first, second and third hopper sides that terminate in the spout.

3. The fluid compressor as claimed in claim 1 wherein the spout is rectangular and has an open discharge side.

4. The fluid compressor as claimed in claim 1 wherein the first compressor housing panel is the housing bottom panel.

5. The fluid compressor as claimed in claim 1 wherein the channel is C-shaped and has a first web adapted to support the heat exchanger and a second web adapted to be seated on the first compressor housing panel.

6. The fluid compressor as claimed in claim 1 wherein the compression module comprises of a rotary screw airend.

7. The fluid compressor as claimed in claim 1 wherein the prime mover comprises of a diesel engine.

8. The fluid compressor as claimed in claim 1 wherein the spout is cylindrical.

9. The fluid compressor as claimed in claim 1 wherein the spout is semi-cylindrical rectangular and has an open discharge side.

10. The fluid compressor as claimed in claim 1 wherein the spout is closed by a removable cap.

11. In a compressor having a compressor housing interior enclosing a compression module driven by a prime mover; and an air flow manifold comprising a heat exchanger with an inlet side and discharge side, a shroud with an inlet side and a discharge side having a hopper that terminates in a spout located outside the compressor housing interior, the spout having an opening coplanar to the inlet side of the shroud and a fan driven by the prime mover, a method for cleaning the heat exchanger comprising the steps of:

(A) supplying a pressurized fluid to the discharge side of the heat exchanger;

(B) passing the pressurized fluid through the heat exchanger and out the heat exchanger inlet side thereby dislodging particulate matter accumulated in the heat exchanger; and (C) discharging the particulate matter out of the compressor housing interior through the shroud, hopper and spout.

* * * * *